US011047108B2

(12) United States Patent
Matsuyama et al.

(10) Patent No.: US 11,047,108 B2
(45) Date of Patent: Jun. 29, 2021

(54) WORK MACHINE AND CONTROL METHOD FOR WORK MACHINE

(71) Applicant: KOMATSU LTD., Tokyo (JP)

(72) Inventors: Tom Matsuyama, Tokyo (JP); Ayumi Ohkuma, Tokyo (JP); Takeo Yamada, Tokyo (JP)

(73) Assignee: KOMATSU LTD., Tokyo (JP)

( * ) Notice: Subject to any disclaimer, the term of this patent is extended or adjusted under 35 U.S.C. 154(b) by 6 days.

(21) Appl. No.: 15/756,240

(22) PCT Filed: Jul. 14, 2017

(86) PCT No.: PCT/JP2017/025779
§ 371 (c)(1),
(2) Date: Oct. 18, 2018

(87) PCT Pub. No.: WO2019/012700
PCT Pub. Date: Jan. 17, 2019

(65) Prior Publication Data

US 2019/0032302 A1 Jan. 31, 2019

(51) Int. Cl.

| | |
|---|---|
| ***E02F 3/43*** | (2006.01) |
| ***E02F 9/22*** | (2006.01) |
| ***E02F 3/32*** | (2006.01) |
| ***E02F 9/20*** | (2006.01) |

(52) U.S. Cl.
CPC ..... *E02F 3/435* (2013.01); *E02F 3/32* (2013.01); *E02F 9/2004* (2013.01); *E02F 9/2033* (2013.01); *E02F 9/2214* (2013.01); *E02F 9/2292* (2013.01)

(58) Field of Classification Search
CPC ..... E02F 3/435; E02F 9/2214; E02F 9/2292; E02F 3/32; E02F 9/2004; E02F 9/2033
See application file for complete search history.

(56) References Cited

U.S. PATENT DOCUMENTS 5,308,219 A * 5/1994 Lee ..... E02F 3/435 414/695.5
5,361,211 A * 11/1994 Lee ..... E02F 9/123 340/679
2014/0142817 A1 5/2014 Matsuyama
2015/0159682 A1 6/2015 Bae et al.
2015/0308081 A1 10/2015 Takaura et al.
(Continued)

FOREIGN PATENT DOCUMENTS

JP 2001-098585 A 4/2001
JP 2001-303610 A 10/2001
(Continued)

*Primary Examiner* — Peter D Nolan
*Assistant Examiner* — Ashley L Redhead, Jr.
(74) *Attorney, Agent, or Firm* — Faegre Drinker Biddle & Reath LLP

(57) ABSTRACT

A work machine according an aspect includes a work implement, an operation apparatus for operating the work implement, and a controller for controlling the work implement. The controller performs intervention control for lowering the work implement based on an operation command from the operation apparatus, and reduces a speed of the work implement during the intervention control to stop the work implement before completion of the intervention control.

8 Claims, 12 Drawing Sheets

(56) References Cited

U.S. PATENT DOCUMENTS

| | | | | |
|---|---|---|---|---|
| 2016/0076224 | A1* | 3/2016 | Edara | E01C 19/004 701/50 |
| 2016/0258135 | A1 | 9/2016 | Shimano et al. | |
| 2017/0089033 | A1 | 3/2017 | Matsuyama et al. | |
| 2017/0145662 | A1 | 5/2017 | Iwasaki et al. | |
| 2017/0247861 | A1 | 8/2017 | Matsuyama et al. | |
| 2017/0292248 | A1* | 10/2017 | Matson | E02F 9/261 |

FOREIGN PATENT DOCUMENTS

| | | | |
|---|---|---|---|
| JP | 2015-196968 | A | 11/2015 |
| JP | 2015-206408 | A | 11/2015 |
| JP | 2017-57694 | A | 3/2017 |
| KR | 20170037807 | A | 4/2017 |
| WO | WO-2012/127912 | A1 | 9/2012 |
| WO | WO-2014/192474 | A1 | 12/2014 |
| WO | WO-2015/025989 | A1 | 2/2015 |
| WO | WO-2016/056678 | A1 | 4/2016 |
| WO | WO-2016/111384 | A1 | 7/2016 |

* cited by examiner

WORK MACHINE AND CONTROL METHOD FOR WORK MACHINE

TECHNICAL FIELD

The present invention relates to a work machine including a work implement, and a control method for a work machine.

BACKGROUND ART

For a work machine that includes a front device provided with a bucket, there has been proposed such control that shifts the bucket along a boundary surface defining a target shape of an object of execution (for example, see PTDs 1 and 2). This control is referred to as intervention control.

In some situations, this intervention control for the target shape of the object of execution is difficult to perform depending on the attitude of the work implement of the work machine.

More specifically, during land grading by dumping with a dipper stick, a rapid change of a cylinder speed may be produced when the dipper stick arrives at a position close to a stroke end of a dipper stick cylinder. A change of the cylinder speed may affect accuracy of land grading. Accordingly, the intervention control may be brought to a stop when the dipper stick arrives at the position close to the stroke end of the dipper stick cylinder.

CITATION LIST

Patent Document

PTD 1: WO 2012/127912
PTD 2: WO 2016/056678

SUMMARY OF INVENTION

Technical Problem

However, a rapid speed change of the work implement at the time of a stop of the intervention control applies a shock to the work machine.

The present disclosure has been developed to solve the aforementioned problems. An object of the present disclosure is to provide a work machine and a control method for a work machine capable of reducing a shock applied to a work implement at the time of a stop of intervention control.

Solution to Problem

A work machine according an aspect includes a work implement, an operation apparatus for operating the work implement, and a controller for controlling the work implement. The controller performs intervention control for lowering the work implement based on an operation command from the operation apparatus, and reduces a speed of the work implement during the intervention control to stop the work implement before completion of the intervention control.

Advantageous Effects of Invention

The work machine and the control method for the work machine are capable of reducing a shock applied to a work implement at the time of a stop of intervention control.

DESCRIPTION OF EMBODIMENT

An embodiment of the present invention is hereinafter described with reference to the drawings. In the following description, identical parts are given identical reference numbers. These identical parts have identical names and functions, wherefore details of these parts are not repeatedly described herein. Note that "upper", "lower", "fore", "after", "left", and "right" in the following description are terms defined as viewed from a reference corresponding to an operator sitting on an operator's seat.

<General Configuration of Work Machine>

Figure 1:
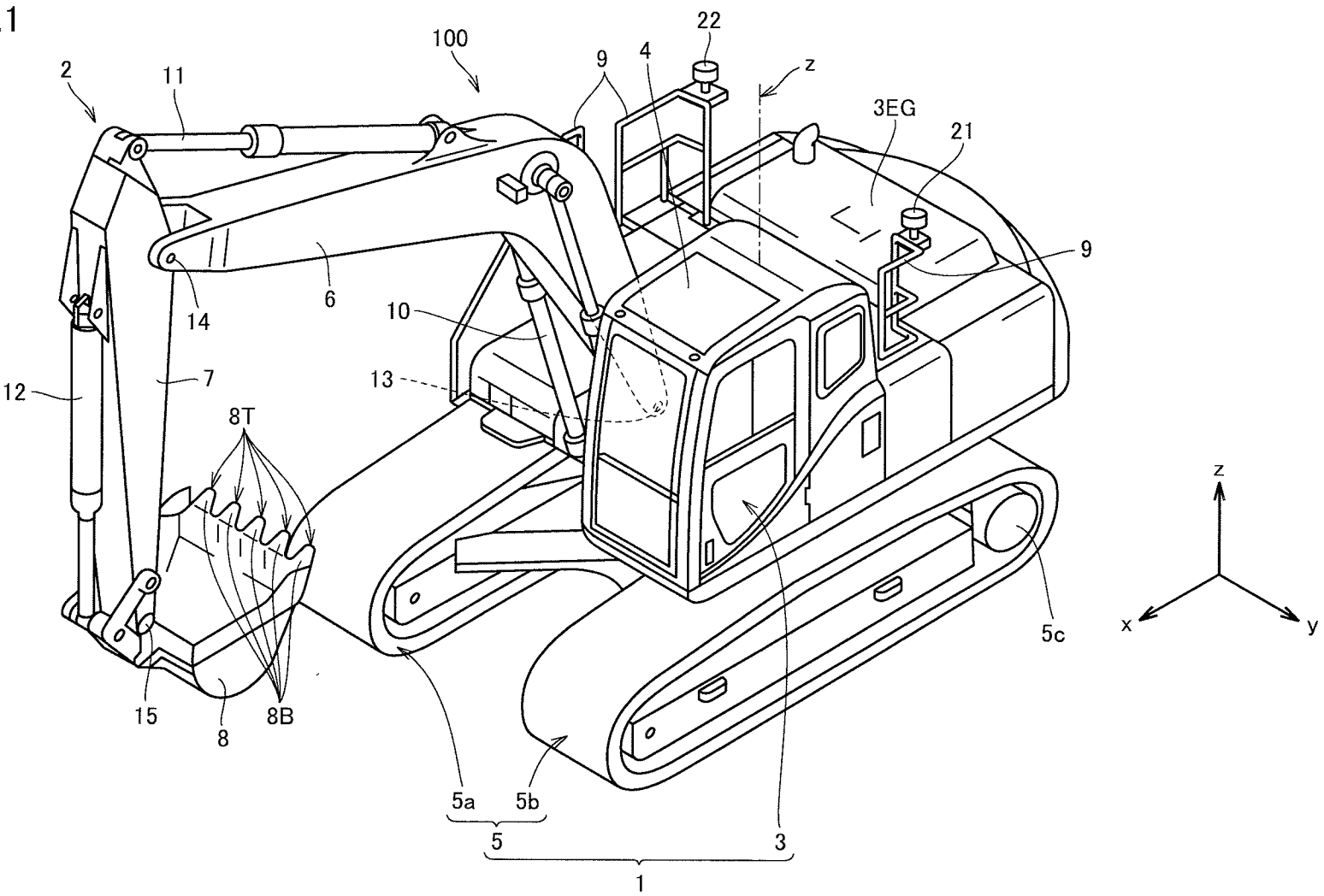
FIG. 1 is a perspective view of a work machine according to an embodiment.

FIG. 1 is a perspective view of a work machine according to the embodiment.

Figure 2:
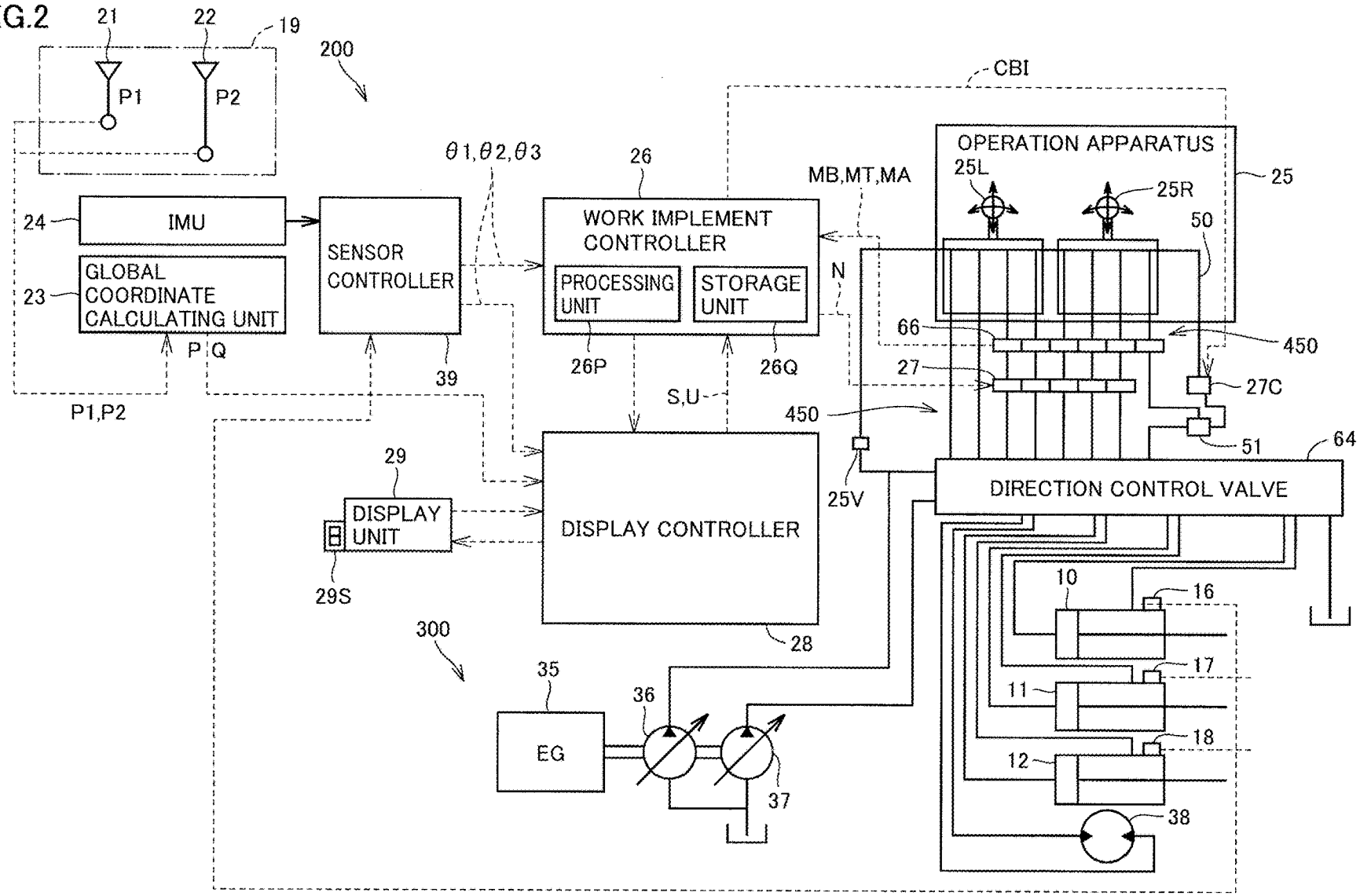
FIG. 2 is a block diagram illustrating configurations of a control system 200 and a hydraulic system 300 included in a hydraulic excavator 100 according to the embodiment.

FIG. 2 is a block diagram illustrating configurations of a control system 200 and a hydraulic system 300 included in a hydraulic excavator 100 according to the embodiment.

Referring to FIG. 1, hydraulic excavator 100 provided as a work machine includes a vehicular body 1 and a work implement 2.

Vehicular body 1 includes an upper revolving unit 3 provided as a revolving unit, and a traveling apparatus 5 provided as a traveling unit. Upper revolving unit 3 accommodates an internal combustion engine provided as a power generator, hydraulic pumps, and other devices within an engine room 3EG. Engine room 3EG is disposed at an end of upper revolving unit 3.

According to the embodiment, the internal combustion engine provided as a power generator of hydraulic excavator 100 is constituted by a diesel engine, for example. However, the power generator may be constituted by other types of power generator.

For example, the power generator of hydraulic excavator 100 may be a hybrid type device constituted by a combination of an internal combustion engine, a generator motor, and an electrical storage device.

The power generator of hydraulic excavator 100 may be constituted by a combination of an electrical storage device and a generator motor, excluding an internal combustion engine.

Upper revolving unit 3 includes an operator's cab 4. Operator's cab 4 is disposed at the other end of upper revolving unit 3. Operator's cab 4 is positioned on the side opposite to the side of engine room 3EG. A display unit 29 and an operation apparatus 25 illustrated in FIG. 2 are disposed within operator's cab 4.

Traveling apparatus 5 supports upper revolving unit 3. Traveling apparatus 5 includes crawler belts 5*a* and 5*b*. One or both of travel motors 5*c* provided on the left and right of traveling apparatus 5 drive and rotate crawler belts 5*a* and 5*b* to allow traveling of hydraulic excavator 100. Work implement 2 is attached to a side of operator's cab 4 of upper revolving unit 3.

Hydraulic excavator 100 may include a traveling apparatus provided with tires instead of crawler belts 5*a* and 5*b*, and transmit driving force of an engine to the tires via a transmission to allow traveling. Examples of hydraulic excavator 100 of this type include a wheel hydraulic excavator.

Hydraulic excavator 100 may be a backhoe loader, for example.

The front of upper revolving unit 3 corresponds to the side where work implement 2 and operator's cab 4 are disposed, while the rear of upper revolving unit 3 corresponds to the side where engine room 3EG is disposed. The left side in the forward direction corresponds to the left of upper revolving unit 3, while the right side in the forward direction corresponds to the right of upper revolving unit 3. The left/right direction of upper revolving unit 3 is also referred to as a width direction. Traveling apparatus 5 side of hydraulic excavator 100 or vehicular body 1 with respect to upper revolving body 3 corresponds to the lower side, while upper revolving unit 3 side with respect to traveling apparatus 5 corresponds to the upper side. The fore/aft direction, the width direction, and the up/down direction of hydraulic excavator 100 correspond to an x direction, a y direction, and a z direction, respectively. When hydraulic excavator 100 is disposed on a horizontal plane, the lower side corresponds to the gravitating side in the direction of gravity identical to the perpendicular direction, while the upper side corresponds to the side opposite to the gravitating side in the perpendicular direction.

Work implement 2 includes a boom 6, a dipper stick 7, a bucket 8 provided as a work tool, a boom cylinder 10, a dipper stick cylinder 11, and a bucket cylinder 12. A proximal end of boom 6 is attached to a front portion of vehicular body 1 via a boom pin 13. A proximal end of dipper stick 7 is attached to a distal end of boom 6 via a dipper stick pin 14. Bucket 8 is attached to a distal end of dipper stick 7 via a bucket pin 15. Bucket 8 is movable around bucket pin 15. A plurality of cutters 8B are attached to bucket 8 on the side opposite to bucket pin 15. Cutting edges 8T correspond to distal ends of cutters 8B.

According to the embodiment, rising of work implement 2 refers to a movement of work implement 2 in the direction from a ground engaging surface of hydraulic excavator 100 toward upper revolving unit 3. Lowering of work implement 2 refers to a movement of work implement 2 in the direction from upper revolving unit 3 of hydraulic excavator 100 toward the ground engaging surface. The ground engaging surface of hydraulic excavator 100 is a flat surface defined by at least three points of engaging portions between crawler belts 5*a* and 5*b* and the ground.

In case of a work machine not provided with upper revolving unit 3, rising of implement 2 refers to a movement of work implement 2 in the direction away from a ground engaging surface of the work machine. Lowering of work implement 2 refers to a movement of work implement 2 in the direction of approach toward the ground engaging surface of the work machine. When the work machine has wheels instead of crawler belts, the ground engaging surface is a flat surface defined by ground engaging portions of at least three wheels.

Bucket 8 is not required to have the plurality of cutters 8B. Such a bucket is adoptable which does not have cutters 8B illustrated in FIG. 1, but has a cutting edge constituted by a steel plate in a straight shape. Work implement 2 may include a tilt bucket having a single cutter, for example. The tilt bucket herein is a bucket that includes a bucket tilt cylinder, and tilts toward the left and right to form or grade a slope or a flat land into a desired shape, and also perform rolling compaction by using a bottom plate even when the hydraulic excavator is on a slope area. Alternatively, work implement 2 may include a drilling attachment provided with a slope bucket or a drilling chip as a work tool, for example, in place of bucket 8.

Each of boom cylinder 10, dipper stick cylinder 11, and bucket cylinder 12 illustrated in FIG. 1 is a hydraulic cylinder driven by a pressure of hydraulic oil (hereinafter referred to as oil pressure where appropriate). Boom cylinder 10 drives boom 6 to raise and lower boom 6. Dipper stick cylinder 11 drives dipper stick 7 to move dipper stick 7 around dipper stick pin 14. Bucket cylinder 12 drives bucket 8 to move bucket 8 around bucket pin 15.

A direction control valve 64 illustrated in FIG. 2 is provided between the hydraulic cylinders such as boom cylinder 10, dipper stick cylinder 11, and bucket cylinder 12, and hydraulic pumps 36 and 37 illustrated in FIG. 2. Direction control valve 64 controls flow rates of hydraulic oil supplied from hydraulic pumps 36 and 37 to boom cylinder 10, dipper stick cylinder 11, bucket cylinder 12 and others, and switches flow directions of hydraulic oil. Direction control valve 64 includes a travel direction control valve for driving travel motors 5*c*, and a work implement direction control valve for controlling revolving motors that revolve boom cylinder 10, dipper stick cylinder 11, bucket cylinder 12, and upper revolving unit 3.

Work implement controller 26 illustrated in FIG. 2 controls a control valve 27 illustrated in FIG. 2 to control a pilot pressure of hydraulic oil supplied from operation apparatus 25 to direction control valve 64. Control valve 27 is included in a hydraulic system of boom cylinder 10, dipper stick cylinder 11, and bucket cylinder 12. Work implement controller 26 controls control valve 27 included in a pilot oil path 450 to control movements of boom cylinder 10, dipper stick cylinder 11, and bucket cylinder 12.

Work implement controller 26 according to the embodiment closes control valve 27 to reduce respective speeds of boom cylinder 10, dipper stick cylinder 11, and bucket cylinder 12.

Antennas 21 and 22 are attached to an upper part of upper revolving unit 3. Antennas 21 and 22 are used to detect a current position of hydraulic excavator 100. Antennas 21 and 22 are electrically connected with a position detection device 19 illustrated in FIG. 2 and provided as a position detector for detecting a current position of hydraulic excavator 100.

Position detection device 19 detects a current position of hydraulic excavator 100 by utilizing real time kinematic-global navigation satellite systems (Real Time Kinematic-Global Navigation Satellite Systems). In the following description, antennas 21 and 22 are referred to as GNSS antennas 21 and 22 where appropriate. When GNSS antennas 21 and 22 receive a GNSS radio wave, a signal in the GNSS radio wave is input to position detection device 19. Position detection device 19 detects installation positions of GNSS antennas 21 and 22. Position detection device 19 includes a three-dimensional position sensor, for example.

<Hydraulic System 300>

Referring to FIG. 2, hydraulic system 300 of hydraulic excavator 100 includes an internal combustion engine 35 provided as a power generation source, and hydraulic pumps 36 and 37. Hydraulic pumps 36 and 37 driven by internal combustion engine 35 discharge hydraulic oil. The hydraulic oil discharged from hydraulic pumps 36 and 37 is supplied to boom cylinder 10, dipper stick cylinder 11, and bucket cylinder 12.

Hydraulic excavator 100 includes a revolving motor 38. Revolving motor 38 is a hydraulic motor driven by hydraulic oil discharged from hydraulic pumps 36 and 37. Revolving motor 38 revolves upper revolving unit 3. Note that only a single hydraulic pump may be provided instead of two hydraulic pumps 36 and 37 illustrated in FIG. 2. Revolving motor 38 may be a motor other than a hydraulic motor, such as an electric motor.

<Control System 200>

Referring to FIG. 2, control system 200 provided as a control system for the work machine includes position detection device 19, a global coordinate calculating unit 23, operation apparatus 25, work implement controller 26 provided as a controller of the work machine according to the embodiment, a sensor controller 39, a display controller 28, and display unit 29.

Operation apparatus 25 is a device for operating work implement 2 and upper revolving unit 3 illustrated in FIG. 1. Operation apparatus 25 is a device for operating work implement 2. Operation apparatus 25 receives an operation for driving work implement 2 from the operator, and outputs a pilot oil pressure corresponding to a manipulated variable.

The pilot oil pressure corresponding to a manipulated variable is equivalent to an operation command. This operation command is a command for moving work implement 2.

The operation command is generated by operation apparatus 25. Operation apparatus 25 is operated by the operator, wherefore the operation command is a command for moving work implement 2 based on an operation input by the operator as a manual operation.

According to the embodiment, operation apparatus 25 includes a left control lever 25L provided on the left side of the operator, and a right control lever 25R provided on the right side of the operator.

For example, an operation of right control lever 25R in the fore/aft direction is associated with an operation of boom 6. When right control lever 25R is operated forward, boom 6 lowers. When right control lever 25R is operated rearward, boom 6 rises. The lowering and rising movements of boom 6 are performed in accordance with operations in the fore/aft direction.

An operation of right control lever 25R in the left/right direction is associated with an operation of bucket 8. When right control lever 25R is operated leftward, bucket 8 performs excavation. When right control lever 25R is operated rightward, bucket 8 performs dumping. The excavation or dumping movement of bucket 8 is performed in accordance with an operation in the left/right direction.

An operation of left control lever 25L in the fore/aft direction is associated with an operation of dipper stick 7. When left control lever 25L is operated forward, dipper stick 7 performs dumping. When left control lever 25L is operated rearward, dipper stick 7 performs excavation.

An operation of left control lever 25L in the left/right direction is associated with a revolution of upper revolving unit 3. When left control lever 25L is operated leftward, upper revolving unit 3 revolves leftward. When left control lever 25L is operated rightward, upper revolving unit 3 revolves rightward.

According to the embodiment, operation apparatus 25 is a device of pilot hydraulic type. Hydraulic oil having a pressure reduced to a predetermined pilot pressure by pressure reducing valve 25V is supplied from hydraulic pump 36 to operation apparatus 25 in accordance with a boom operation, a bucket operation, a dipper stick operation, and a revolving operation.

An operation of right control lever 25R in the fore/aft direction allows supply of a pilot oil pressure to pilot oil path 450. In this state, the operation of boom 6 is received from the operator. Hydraulic oil is supplied to pilot oil path 450 by opening of the valve device of right control lever 25R in accordance with a manipulated variable of right control lever 25R.

Pressure sensor 66 detects a pressure of hydraulic oil within pilot oil path 450 at the time of the supply of hydraulic oil as a pilot pressure.

Pressure sensor 66 designates the detected pilot pressure as a boom manipulated variable MB, and transmits boom manipulated variable MB to work implement controller 26. A manipulated variable of right control lever 25R in the fore/aft direction is hereinafter referred to as boom manipulated variable MB where appropriate. A control valve (hereinafter referred to as intervention valve where appropriate) 27C, and a shuttle valve 51 are included in pilot oil path 50. Intervention valve 27C and shuttle valve 51 will be detailed below.

An operation of right control lever 25R in the left/right direction allows supply of a pilot oil pressure to pilot oil path 450. In this state, the operation of bucket 8 is received from the operator. Hydraulic oil is supplied to pilot oil path 450 by opening of the valve device of right control lever 25R in accordance with a manipulated variable of right control lever 25R.

Pressure sensor 66 detects a pressure of hydraulic oil within pilot oil path 450 at the time of the supply of hydraulic oil as a pilot pressure. Pressure sensor 66 designates the detected pilot pressure as a bucket manipulated variable MT, and transmits bucket manipulated variable MT to work implement controller 26. A manipulated variable of right control lever 25R in the left/right direction is hereinafter referred to as bucket manipulated variable MT where appropriate.

An operation of left control lever 25L in the fore/aft direction allows supply of a pilot oil pressure to pilot oil path 450. In this state, the operation of dipper stick 7 is received from the operator. Hydraulic oil is supplied to pilot oil path 450 by opening of a valve device of left control lever 25L in accordance with a manipulated variable of left control lever 25L.

Pressure sensor 66 detects a pressure of hydraulic oil within pilot oil path 450 at the time of the supply of hydraulic oil as a pilot pressure. Pressure sensor 66 designates the detected pilot pressure as an dipper stick manipulated variable MA, and transmits dipper stick manipulated variable MA to work implement controller 26. A manipulated variable of left control lever 25L in the fore/aft direction is hereinafter referred to as dipper stick manipulated variable MA where appropriate.

When right control lever 25R is operated, operation apparatus 25 supplies to direction control valve 64 a pilot oil pressure at a level corresponding to a manipulated variable of right control lever 25R.

When left control lever 25L is operated, operation apparatus 25 supplies to direction control valve 64 a pilot oil pressure at a level corresponding to a manipulated variable of left control lever 25L. Direction control valve 64 moves in accordance with a pilot oil pressure supplied from operation apparatus 25 to direction control valve 64.

Control system 200 includes a first stroke sensor 16, a second stroke sensor 17, and a third stroke sensor 18. For example, first stroke sensor 16 is included in boom cylinder 10, second stroke sensor 17 is included in dipper stick cylinder 11, and third stroke sensor 18 is included in bucket cylinder 12.

Sensor controller 39 includes a storage unit such as a random access memory (RAM) and a read only memory (ROM), and a processing unit such as a central processing unit (CPU).

Sensor controller 39 calculates an inclination angle θ1 of boom 6 with respect to a direction (z-axis direction) perpendicular to a horizontal plane (x-y plane) in a local coordinate system of hydraulic excavator 100, more specifically, a local coordinate system of vehicular body 1, based on a boom cylinder length LS1 detected by first stroke sensor 16, and outputs calculated inclination angle θ1 to work implement controller 26 and display controller 28.

Sensor controller 39 calculates an inclination angle θ2 of dipper stick 7 with respect to boom 6 based on a dipper stick cylinder length LS2 detected by second stroke sensor 17, and outputs calculated inclination angle θ2 to work implement controller 26 and display controller 28.

Sensor controller 39 calculates an inclination angle θ3 of cutting edges 8T of bucket 8 with respect to dipper stick 7 based on a bucket cylinder length LS3 detected by third stroke sensor 18, and outputs calculated inclination angle θ3 to work implement controller 26 and display controller 28.

Inclination angles θ1, θ2, and θ3 may be detected by methods other than the use of first stroke sensor 16, second stroke sensor 17, and third stroke sensor 18. For example, an angle sensor such as a potentiometer may be used to detect inclination angles θ1, θ2, and θ3.

An inertial measurement unit (IMU) 24 is connected to sensor controller 39. IMU 24 acquires information about inclination of the vehicular body such as a pitch around the y axis and a roll around the x axis of hydraulic excavator 100 illustrated in FIG. 1, and outputs the acquired information to sensor controller 39.

Work implement controller 26 includes a storage unit 26Q such as a RAM and a read only memory (ROM), and a processing unit 26P such as a CPU. Work implement controller 26 controls intervention valve 27C and control valve 27 based on boom manipulated variable MB, bucket manipulated variable MT, and dipper stick manipulated variable MA illustrated in FIG. 2.

Direction control valve 64 illustrated in FIG. 2 is a proportional control valve, for example, and is controlled by hydraulic oil supplied from operation apparatus 25.

Direction control valve 64 is disposed between the section of boom cylinder 10, dipper stick cylinder 11, bucket cylinder 12, and a hydraulic actuator such as revolving motor 38, and the section of hydraulic pumps 36 and 37.

Direction control valve 64 controls flow rates and directions of hydraulic oil supplied from hydraulic pumps 36 and 37 to boom cylinder 10, dipper stick cylinder 11, bucket cylinder 12, and revolving motor 38.

Position detection device 19 contained in control system 200 includes GNSS antennas 21 and 22 described above. When GNSS antennas 21 and 22 receive a GNSS radio wave, a signal in the GNSS radio wave is input to global coordinate calculating unit 23.

GNSS antenna 21 receives reference position data P1 indicating a self-position from a positioning satellite. GNSS antenna 22 receives reference position data P2 indicating a self-position from the positioning satellite.

GNSS antennas 21 and 22 receive reference position data P1 and P2 in a predetermined cycle. Each of reference position data P1 and P2 is information indicating the installation position of the corresponding GNSS antenna. GNSS antennas 21 and 22 output reference position data P1 and P2 to global coordinate calculating unit 23 every time GNSS antennas 21 and 22 receive these data P1 and P2.

Global coordinate calculating unit 23 includes a storage unit such as a RAM and a ROM, and a processing unit such as a CPU. Global coordinate calculating unit 23 generates revolving unit position data indicating a position of upper revolving unit 3 based on two reference position data P1 and P2.

According to the embodiment, the revolving unit position data includes reference position data P corresponding to one of two reference position data P1 and P2, and revolving unit direction data Q generated based on two reference position data P1 and P2. Revolving unit direction data Q indicates a direction in which work implement 2, i.e., upper revolving unit 3, faces.

Global coordinate calculating unit 23 updates reference position data P and revolving unit direction data Q each indicating revolving unit position data, and outputs the updated data to display controller 28 every time two reference position data P1 and P2 are acquired from GNSS antennas 21 and 22 in a predetermined cycle.

Display controller 28 includes a storage unit such as a RAM and a ROM, and a processing unit such as a CPU. Display controller 28 acquires reference position data P and revolving unit direction data Q each indicating revolving unit position data from global coordinate calculating unit 23.

According to the embodiment, display controller 28 generates, as work implement position data, bucket cutting edge position data S indicating a three-dimensional position of cutting edges 8T of bucket 8. Display controller 28 subsequently generates target excavation topography data U based on bucket cutting edge position data S and target execution information T.

Target execution information T is information indicating a service object by work implement 2 included in hydraulic excavator 100, or a finishing target of an excavation object according to the embodiment. Examples of target execution information T include design information about an execution object by hydraulic excavator 100. Examples of a service object by work implement 2 include land. Examples of a service performed by work implement 2 include an excavation service and a land grading service. However, the service by work implement 2 is not limited to these examples.

Display controller 28 derives target excavation landform data Ua for display based on target excavation landform data U, and displays a target shape of a service object by work implement 2, such as a landform, on display unit 29 based on target excavation landform data Ua for display.

Display unit 29 is a liquid crystal display apparatus that receives input via a touch panel, for example. However, display unit 29 is not limited to this type. According to the embodiment, a switch 29S is provided adjacent to display unit 29. Switch 29S is an input device operated to perform intervention control described below, or stop the intervention control being performed.

Work implement controller 26 acquires boom manipulated variable MB, bucket manipulated variable NIT, and dipper stick manipulated variable MA from pressure sensor 66. Work implement controller 26 acquires inclination angle θ1 of boom 6, inclination angle θ2 of dipper stick 7, and inclination angle θ3 of bucket 8 from sensor controller 39.

Work implement controller 26 acquires target excavation topography data U from display controller 28. Target excavation topography data U is information included in target execution information T and indicating a range of a service that will be performed by hydraulic excavator 100.

Target excavation topography data U is a part of target execution information T. Target excavation topography data U indicates a shape of a finishing target of a service object of work implement 2 similarly to target execution information T. The shape of the finishing target is hereinafter referred to as target excavation topography where appropriate.

Work implement controller 26 calculates a position of cutting edges 8T of bucket 8 (hereinafter referred to as cutting edge position where appropriate) based on an angle of work implement 2 acquired from sensor controller 39.

Work implement controller 26 controls a movement of work implement 2 based on a distance between target excavation topography data U and cutting edges 8T of bucket 8, and on a speed of work implement 2 such that cutting edges 8T of bucket 8 can shift in accordance with target excavation topography data U.

Work implement controller 26 performs such control as to maintain a speed of work implement 2 in a direction of approach toward an execution object at a speed less than or equal to a speed limit to prevent bucket 8 from invading a target shape of a service object of work implement 2 indicated by target excavation topography data U. This control is referred to as intervention control where appropriate.

For example, the intervention control is performed when the operator of hydraulic excavator 100 selects performance of the intervention control by using switch 29S illustrated in FIG. 2. When a distance between target excavation topography described below and bucket 8 is calculated, a reference position of bucket 8 is not limited to the position of cutting edges 8T but may be other appropriate positions.

During the intervention control, work implement controller 26 generates a boom command signal CBI, and outputs generated boom command signal CBI to intervention valve 27C illustrated in FIG. 2 to control work implement 2 such that cutting edges 8T of bucket 8 can shift in accordance with target excavation topography data U.

Boom 6 moves based on boom command signal CBI. A speed of work implement 2, more specifically a speed of bucket 8, is controlled by a movement of boom 6 based on boom command signal CBI. An approaching speed of bucket 8 toward target excavation topography data U is regulated in accordance with a distance between bucket 8 and target excavation topography data U.

<Configuration of Hydraulic Circuit 301>

Figure 3:
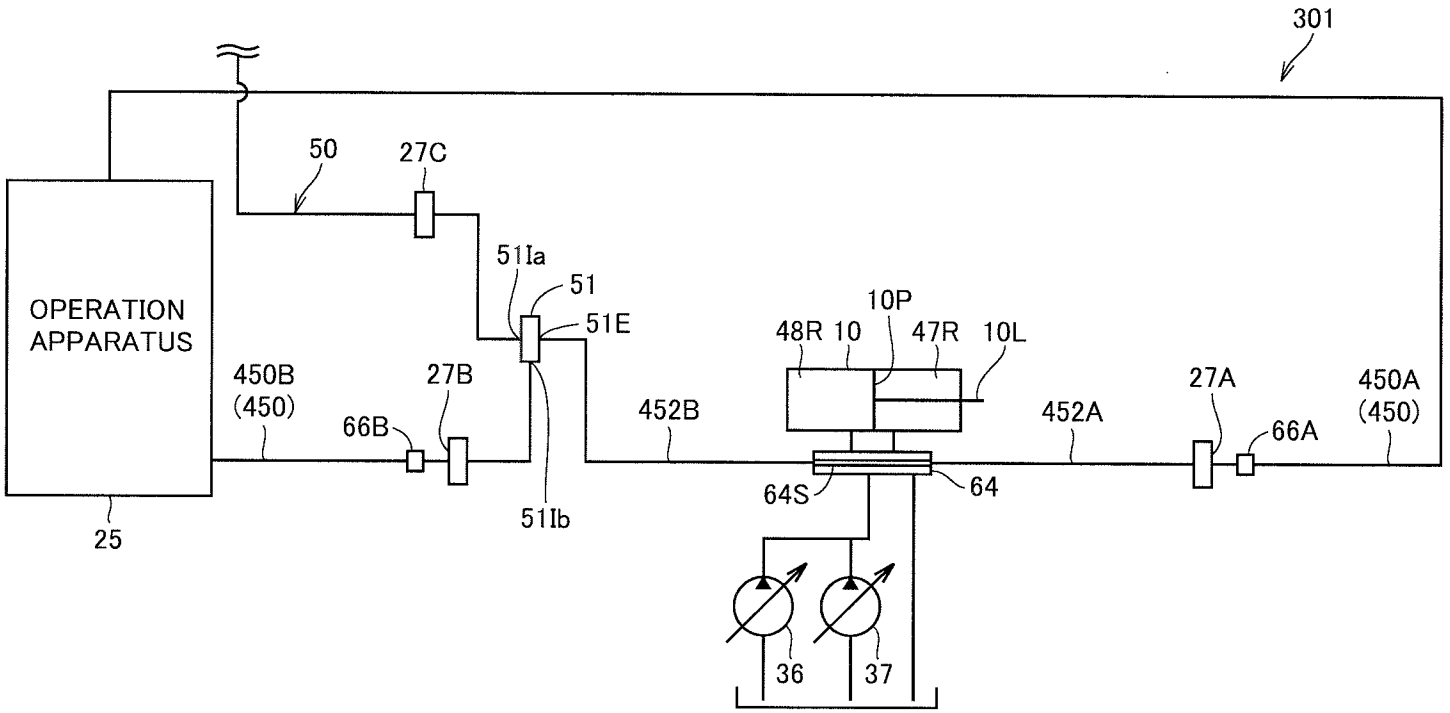
FIG. 3 is a diagram illustrating an example of a hydraulic circuit 301 included in a boom cylinder 10 according to the embodiment.

FIG. 3 is a diagram illustrating an example of hydraulic circuit 301 of boom cylinder 10 according to the embodiment.

Referring to FIG. 3, hydraulic circuit 301 includes pilot oil path 450 between operation apparatus 25 and direction control valve 64. Direction control valve 64 is a valve for controlling a flow direction of hydraulic oil supplied to boom cylinder 10.

According to the embodiment, direction control valve 64 is a spool valve that shifts a rod-shaped spool 64S to switch a flow direction of hydraulic oil.

Spool 64S is shifted by hydraulic oil supplied from operation apparatus 25 illustrated in FIG. 2 (hereinafter referred to as pilot oil where appropriate). Direction control valve 64 supplies hydraulic oil to boom cylinder 10 by a shift of spool 64S to move boom cylinder 10.

Pilot oil path 50 and pilot oil path 450B are connected to shuttle valve 51.

Shuttle valve 51 and one end of direction control valve 64 are connected with each other via an oil path 452B. The other end of direction control valve 64 and operation apparatus 25 are connected with each other via a pilot oil path 450A and a pilot oil path 452A. Pilot oil path 50 includes intervention valve 27C. Intervention valve 27C adjusts a pilot pressure of pilot oil path 50.

Pilot oil path 450B includes a pressure sensor 66B and a control valve 27B. Pilot oil path 450A includes a pressure sensor 66A provided between a control valve 27A and operation apparatus 25. A detection value obtained by pressure sensor 66 is acquired by work implement controller 26 illustrated in FIG. 2, and used for control of boom cylinder 10.

Each of pressure sensor 66 and pressure sensor 66B corresponds to pressure sensor 66 illustrated in FIG. 2. Each of control valve 27A and control valve 27B corresponds to control valve 27 illustrated in FIG. 2.

Hydraulic oil supplied from hydraulic pumps 36 and 37 is further supplied to boom cylinder 10 via direction control valve 64. Supply of hydraulic oil is switched between supply to a cap side oil chamber 48R of boom cylinder 10 and supply to a rod side oil chamber 47R of boom cylinder 10 by a shift of spool 64S in the axial direction.

A flow rate of hydraulic oil, i.e., a supply rate of hydraulic oil to boom cylinder 10 per unit time is adjusted by a shift of spool 64S in the axial direction. A moving speed of boom cylinder 10 is adjusted by adjustment of the flow rate of hydraulic oil to boom cylinder 10.

When spool 64S of direction control valve 64 shifts in a first direction, hydraulic oil is supplied from direction control valve 64 to cap side oil chamber 48R. When hydraulic oil is returned from rod side oil chamber 47R to direction control valve 64, a piston 10P of boom cylinder 10 shifts from cap side oil chamber 48R toward rod side oil chamber 47R. As a result, a rod 10L connected to piston 10P extends from boom cylinder 10.

When spool 64S of direction control valve 64 shifts in a second direction opposite to a first direction based on a command from operation apparatus 25, hydraulic oil is returned from cap side oil chamber 48R to direction control valve 64. When hydraulic oil is supplied from direction control valve 64 to rod side oil chamber 47R, a piston 10P of boom cylinder 10 shifts from rod side oil chamber 47R to cap side oil chamber 48R. As a result, rod 10L connected to piston 10P contracts into boom cylinder 10. In this manner, a moving direction of boom cylinder 10 changes in accordance with adjustment of the shift direction of spool 64S of direction control valve 64.

The flow rate of hydraulic oil supplied to boom cylinder 10 and returned from boom cylinder 10 to direction control valve 64 changes in accordance with the adjustment of the shift amount of spool 64S of direction control valve 64. In this case, each shift speed of piston 10P and rod 10L corresponding to a moving speed of boom cylinder 10 changes accordingly.

As described above, a movement of direction control valve 64 is controlled by operation apparatus 25. Hydraulic oil discharged from hydraulic pump 36 illustrated in FIG. 2 and subjected to pressure reduction by pressure reducing valve 25V is supplied to operation apparatus 25 as pilot oil.

Operation apparatus 25 adjusts the pilot oil pressure based on operations of the respective control levers. Direction control valve 64 is driven by the adjusted pilot oil pressure. The shift amount and shift direction of spool 64S in the axial direction are adjusted by adjustment of the level and direction of the pilot oil pressure by operation apparatus 25. Accordingly, the moving speed and moving direction of boom cylinder 10 are allowed to change.

As described above, work implement controller 26 during the intervention control regulates a speed of boom 6 based on target excavation topography (target excavation topography data U) that indicates design topography corresponding to a target shape of an excavation object, and on inclination angles θ1, θ2, and θ3 used for obtaining a position of bucket 8, such that an approaching speed of bucket 8 toward target excavation topography 43I decreases in accordance with a distance between target excavation topography 43I and bucket 8.

According to the embodiment, work implement controller 26 generates boom command signal CBI and controls a movement of boom 6 based on generated boom command signal CBI to prevent invasion of target excavation topography 43I by cutting edges 8T of bucket 8 when work implement 2 moves based on an operation from operation apparatus 25.

More specifically, work implement controller 26 raises or lowers boom 6 to prevent invasion of target excavation topography 43I by cutting edges 8T during the intervention control. The control for raising or lowering boom 6 performed during the intervention control is referred to as boom intervention control where appropriate.

According to the embodiment, work implement controller 26 generates a boom command signal CBI indicating the boom intervention control, and outputs generated boom command signal CBI to intervention valve 27C or a control valve 27A to achieve the boom intervention control.

Intervention valve 27C is capable of adjusting a pilot oil pressure of pilot oil path 50. Shuttle valve 51 includes two inlet ports 51Ia and 51Ib, and one outlet port 51E. Inlet port 51Ia provided as one of the inlet ports is connected to intervention valve 27C. Inlet port 51Ib provided as the other inlet port is connected to control valve 27B. Outlet port 51E is connected to oil path 452B connected to direction control valve 64.

Shuttle valve 51 connects oil path 452B and the inlet port having a higher pilot oil pressure in two inlet ports 51Ia and 51Ib.

When the pilot oil pressure of inlet port 51Ia is higher than the pilot oil pressure of inlet port 51Ib, for example, shuttle valve 51 connects intervention valve 27C and oil path 452B. As a result, the pilot oil having passed through intervention valve 27C is supplied to oil path 452B via shuttle valve 51.

When the pilot oil pressure of inlet port 51Ib is higher than the pilot oil pressure of inlet port 51Ia, shuttle valve 51 connects control valve 27B with oil path 452B. As a result, the pilot oil having passed through control valve 27B is supplied to oil path 452B via shuttle valve 51.

During a stop of the boom intervention control, direction control valve 64 is driven based on a pilot oil pressure adjusted by an operation from operation apparatus 25. For example, work implement controller 26 opens (full-opens) pilot oil path 450B by controlling control valve 27B, and closes pilot oil path 50 by controlling intervention valve 27C to drive direction control valve 64 based on a pilot oil pressure adjusted by an operation from operation apparatus 25.

When performing the boom intervention control, work implement controller 26 controls control valve 27 to drive direction control valve 64 based on a pilot oil pressure adjusted by intervention valve 27C. For example, when performing control for regulating a shift of bucket 8 toward target excavation topography 43I as the boom intervention control, work implement controller 26 controls intervention valve 27C to raise a pilot oil pressure of pilot oil path 50 adjusted by intervention valve 27C to a pressure higher than a pilot oil pressure of pilot oil path 450B adjusted by operation apparatus 25. In this manner, pilot oil from intervention valve 27C is supplied to direction control valve 64 via shuttle valve 51.

When performing the boom intervention control, work implement controller 26 generates boom command signal CBI as a speed command for raising or lowering boom 6 to control intervention valve 27C or control valve 27A, for example.

More specifically, hydraulic oil is supplied to boom cylinder 10 under control of intervention valve 27C to raise boom 6 at a speed corresponding to boom command signal CBI. In addition, hydraulic oil is supplied to boom cylinder 10 under control of control valve 27A to lower boom 6 at a speed corresponding to boom command signal CBI. In this manner, direction control valve 64 of boom cylinder 10 supplies sufficient hydraulic oil to boom cylinder 10 to raise or lower boom 6 at a speed corresponding to boom command signal CBI. Accordingly, boom cylinder 10 is allowed to raise or lower boom 6.

Each of the hydraulic circuit of dipper stick cylinder 11 and the hydraulic circuit of bucket cylinder 12 has a configuration similar to the configuration of hydraulic circuit 301 of boom cylinder 10 described above, except that intervention valve 27C, shuttle valve 51, and pilot oil path 50 are eliminated.

According to the embodiment, the intervention control is defined as control performed by work implement controller 26 to move at least one of boom 6, dipper stick 7, and bucket 8 constituting work implement 2 when work implement 2 moves based on an operation from operation apparatus 25.

The intervention control is control performed by work implement controller 26 to achieve movement of the work implement when work implement 2 moves based on a manual operation corresponding to an operation from operation apparatus 25. The boom intervention control described above is a mode of the intervention control.

Figure 4:
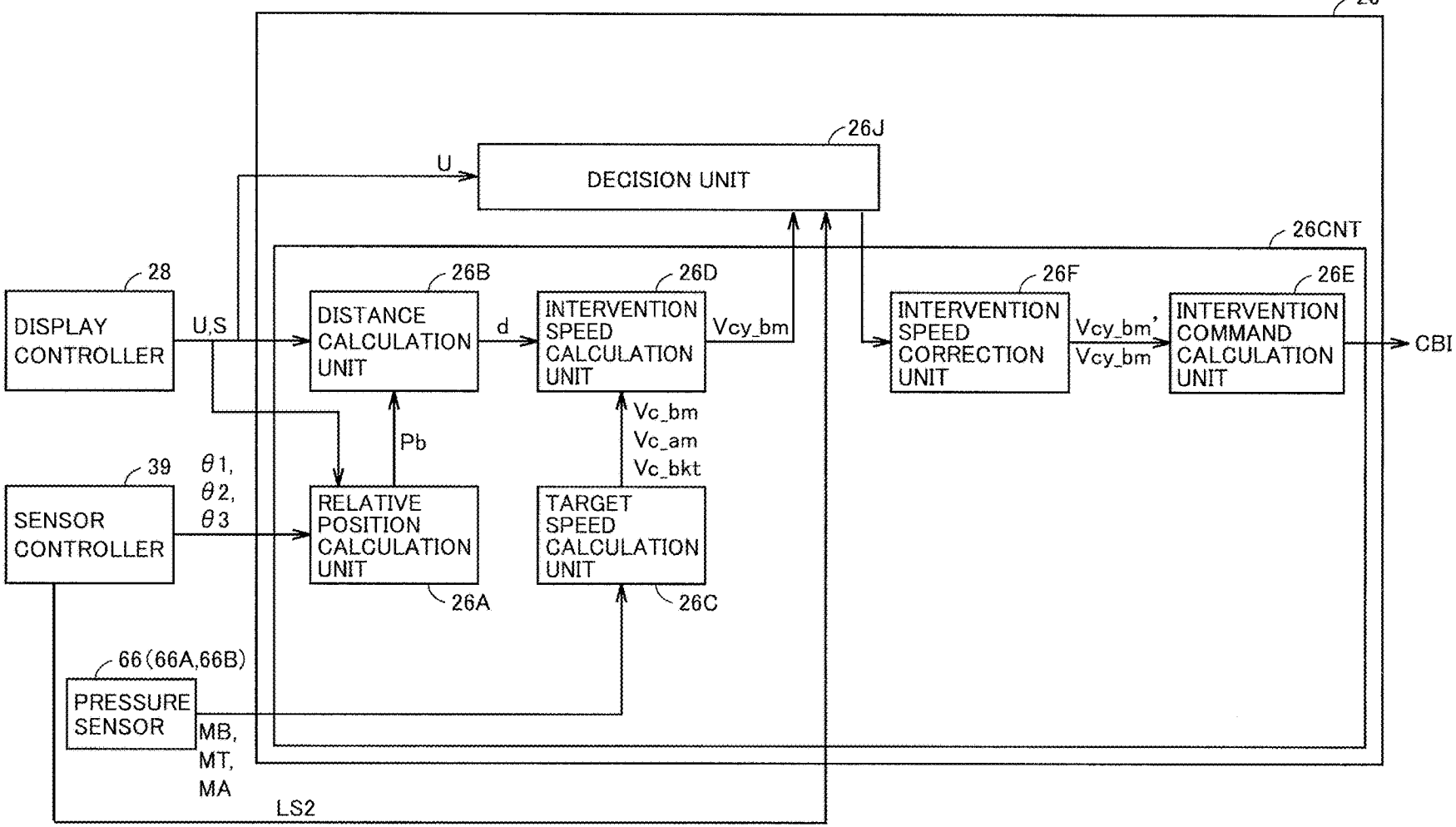
FIG. 4 is a block diagram of a work implement controller 26 according to the embodiment.

FIG. 4 is a block diagram illustrating work implement controller 26 according to the embodiment.

Figure 5:
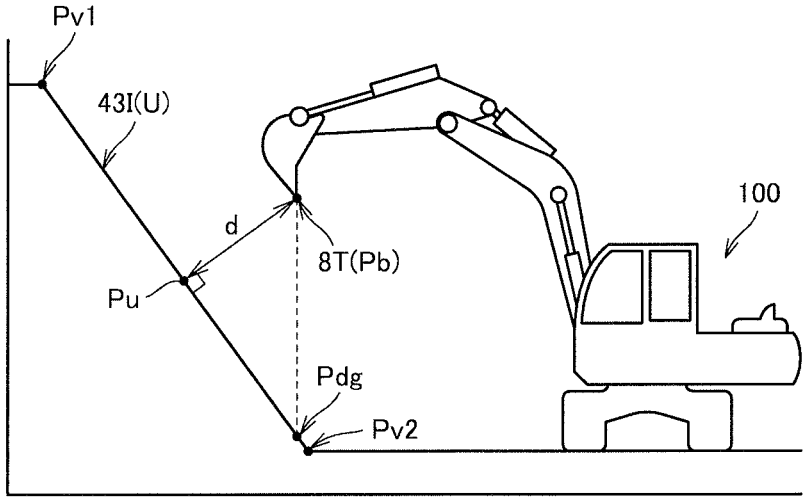
FIG. 5 is a chart illustrating target excavation topography data U and a bucket 8 according to the embodiment.

FIG. 5 is a chart illustrating target excavation topography data U and bucket 8 according to the embodiment.

Figure 6:
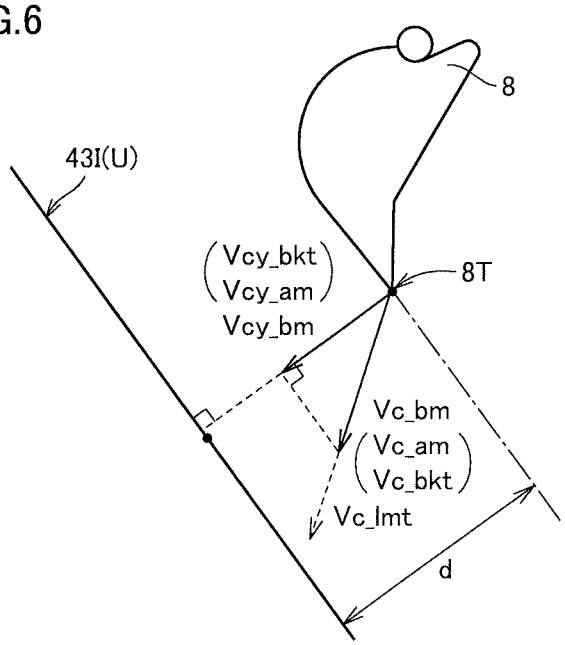
FIG. 6 is a diagram illustrating a boom speed limit Vcy_bm according to the embodiment.

FIG. 6 is a diagram illustrating a boom speed limit Vcy_bm according to the embodiment.

Figure 7:
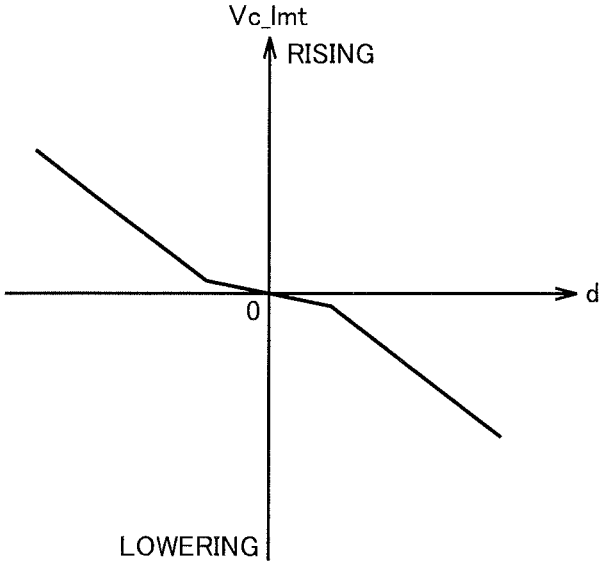
FIG. 7 is a chart illustrating a speed limit Vc_lmt according to the embodiment.

FIG. 7 is a chart illustrating a speed limit Vc_lmt according to the embodiment.

Work implement controller 26 includes a decision unit 26J and a control unit 26CNT. Control unit 26CNT includes a relative position calculation unit 26A, a distance calculation unit 26B, a target speed calculation unit 26C, an intervention speed calculation unit 26D, an intervention command calculation unit 26E, and an intervention speed correction unit 26F.

Functions of decision unit 26J, relative position calculation unit 26A, distance calculation unit 26B, target speed calculation unit 26C, intervention speed calculation unit 26D, intervention command calculation unit 26E, and intervention speed correction unit 26F are performed by processing unit 26P of work implement controller 26 illustrated in FIG. 2.

For performing the intervention control, work implement controller 26 generates boom command signal CBI necessary for the intervention control based on boom manipulated variable MB, dipper stick manipulated variable MA, bucket manipulated variable MT, target excavation topography data U and bucket cutting edge position data S acquired from display controller 28, and inclination angles θ1, θ2, and θ3 acquired from sensor controller 39, and generates a dipper stick command signal and a bucket command signal as necessary to control work implement 2 by driving control valve 27 and intervention valve 27C based on the generated command signal.

Relative position calculation unit 26A acquires bucket cutting edge position data S from display controller 28, and acquires inclination angles θ1, θ2, and θ3 from sensor controller 39. Relative position calculation unit 26A obtains a cutting edge position Pb indicating a position of cutting edges 8T of bucket 8 based on acquired inclination angles θ1, θ2, and θ3.

Distance calculation unit 26B calculates a distance d indicating a minimum distance between cutting edges 8T of bucket 8 and target excavation topography 43I expressed by target excavation topography data U as a part of target execution information T based on cutting edge position Pb obtained by relative position calculation unit 26A and target excavation topography data U acquired from display controller 28. Distance d is a distance between cutting edge position Pb, and a position Pu corresponding to an intersection of target excavation topography data U and a line crossing target excavation topography 43I at right angles and passing through cutting edge position Pb.

Target excavation topography 43I is obtained as a line of intersection formed by a plane of work implement 2 defined in the fore/aft direction of upper revolving unit 3 and passing through an excavation target position Pdg, and target execution information T expressed by a plurality of target execution surfaces.

More specifically, target excavation topography 43I is the line of intersection described above, and formed by a single or a plurality of inflection points fore and after excavation target position Pdg of target execution information T, and lines fore and after the inflection points.

According to an example illustrated in FIG. 5, target excavation topography 43I is formed by two inflection points Pv1 and Pv2, and lines fore and after inflection points Pv1 and Pv2. Excavation target position Pdg is a point located directly below cutting edge position Pb corresponding to the position of cutting edges 8T of bucket 8. Accordingly, target excavation topography 43I is a part of target execution information T. Target excavation topography 43I is generated by display controller 28 illustrated in FIG. 2.

Target speed calculation unit 26C determines a boom target speed Vc_bm, a dipper stick target speed Vc_am, and a bucket target speed Vc_bkt. Boom target speed Vc_bm is a speed of cutting edges 8T during driving of boom cylinder 10. Dipper stick target speed Vc_am is a speed of cutting edges 8T during driving of dipper stick cylinder 11. Bucket target speed Vc_bkt is a speed of cutting edges 8T during driving of bucket cylinder 12. Boom target speed Vc_bm is calculated based on boom manipulated variable MB. Dipper stick target speed Vc_am is calculated based on dipper stick manipulated variable MA. Bucket target speed Vc_bkt is calculated based on bucket manipulated variable MT.

Intervention speed calculation unit 26D obtains speed limit (boom speed limit) Vcy_bm of boom 6 based on distance d between cutting edges 8T of bucket 8 and target excavation topography 43I.

Referring to FIG. 6, intervention speed calculation unit 26D calculates boom speed limit Vcy_bm by subtracting dipper stick target speed Vc_am and bucket target speed Vc_bkt from speed limit Vc_lmt indicating the overall speed limit of work implement 2 illustrated in FIG. 1.

Speed limit Vc_lmt is an allowable shift speed of cutting edges 8T in the direction of approach of cutting edges 8T of bucket 8 toward target excavation topography 43I.

Referring to FIG. 7, work implement 2 has a negative value and lowers when distance d is a positive value. In this case, speed limit Vc_lmt is a lowering speed of work implement 2. On the other hand, work implement 2 has a positive value and rises when distance d is a negative value. In this case, limiting speed Vc_lmt is a rising speed of work implement 2.

A negative value of distance d indicates an invaded state of target excavation topography 43I by bucket 8. The absolute value of speed limit Vc_lmt decreases as distance d decreases. After a change of distance d to a negative value, the absolute value of the speed increases as the absolute value of distance d increases.

Decision unit 26J decides whether to correct boom speed limit Vcy_bm.

When decision unit 26J decides to correct boom speed limit Vcy_bm, intervention speed correction unit 26F corrects boom speed limit Vcy_bm, and outputs corrected boom speed limit Vcy_bm. The corrected boom speed limit is expressed as Vcy_bm'.

When decision unit 26J decides not to correct boom speed limit Vcy_bm, intervention speed correction unit 26F outputs boom speed limit Vcy_bm without correction. Intervention command calculation unit 26E generates boom command signal CBI based on boom speed limit Vcy_bm obtained by intervention speed correction unit 26F.

Boom command signal CBI is a command for setting an opening of intervention valve 27C to a degree sufficient for providing a pilot pressure for shuttle valve 51 to raise boom 6 at boom speed limit Vcy_bm. According to the embodiment, boom command signal CBI is a current value corresponding to the boom command speed.

<Mode of Boom Intervention Control>

Figure 8:
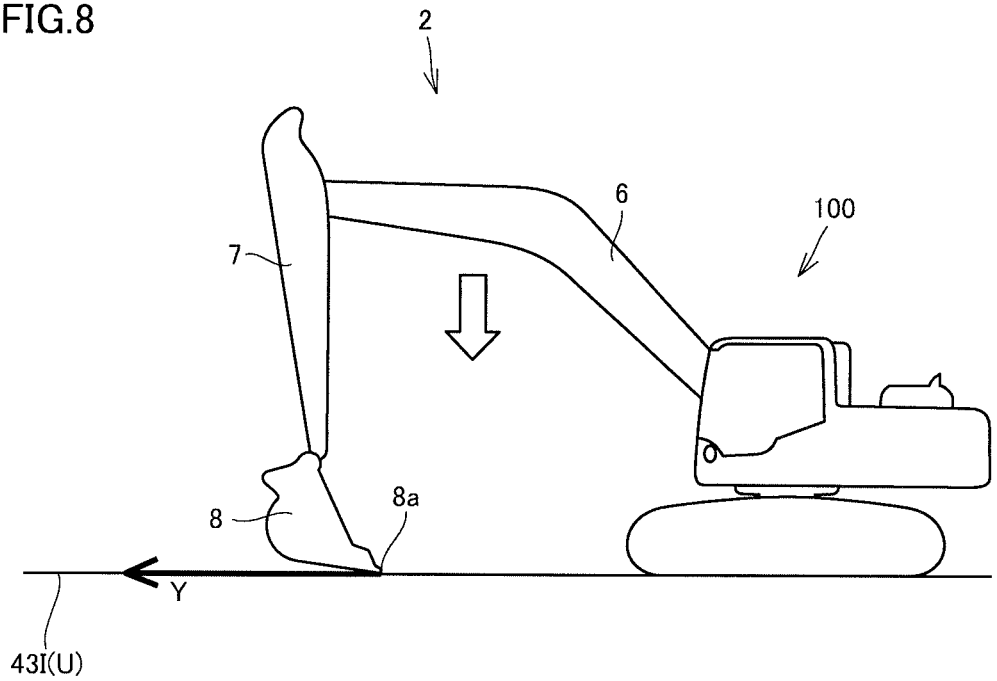
FIG. 8 is a view illustrating an example of a relationship between bucket 8 and target excavation topography 43I according to the embodiment.

FIG. 8 is a view illustrating an example of a relationship between bucket 8 and target excavation topography 43I according to the embodiment.

Referring to FIG. 8, the intervention control is control for shifting bucket 8 to prevent invasion of target excavation topography 43I by bucket 8.

According to the present embodiment, land grading is achieved by a shift of bucket 8 along target excavation topography 43I in a direction indicated by an arrow Y.

More specifically, dipper stick 7 performs dumping in accordance with an operation command input from the operator to operation apparatus 25.

Work implement controller 26 calculates a damping shift amount of dipper stick 7 based on dipper stick manipulated variable MA, and controls lowering of boom 6 such that bucket 8 can shift along target excavation topography 43I in accordance with the calculated dumping shift amount.

Figure 9:
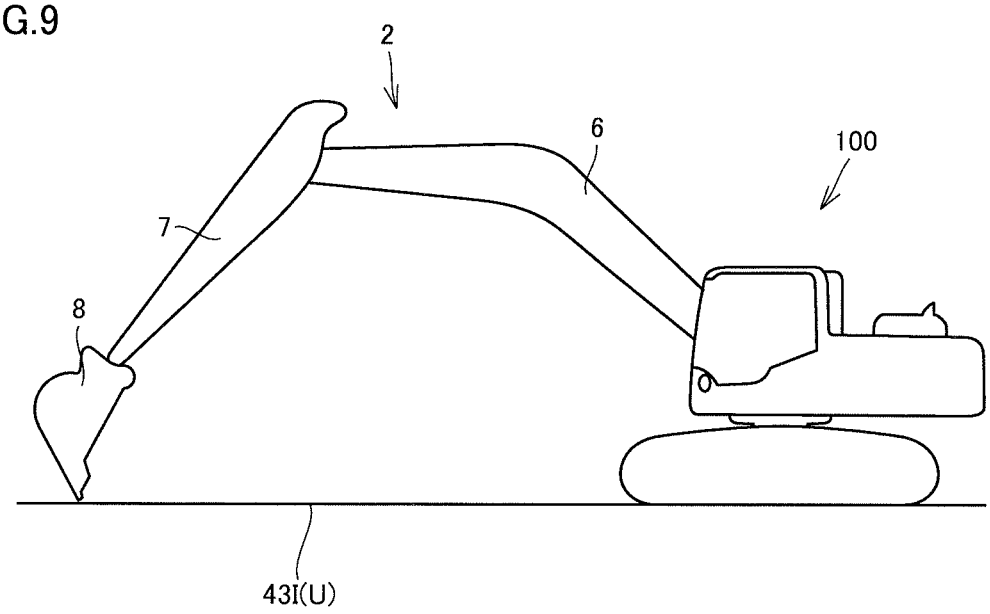
FIG. 9 is another view illustrating the relationship between bucket 8 and target excavation topography 43I according to the embodiment.

FIG. 9 is another view illustrating the relationship between bucket 8 and target excavation topography 43I according to the embodiment.

Referring to FIG. 9, dipper stick 7 dumps by a shift of bucket 8 in the direction of arrow Y from the state illustrated in FIG. 8. With continuation of dumping by dipper stick 7, dipper stick cylinder 11 may arrive at a position close to the stroke end of dipper stick cylinder 11.

In general, dipper stick cylinder 11 has such a characteristic that a cylinder speed may change at a position close to the stroke end.

The change of the cylinder speed may affect accuracy of land grading. Accordingly, the intervention control is canceled, and switched to control for stopping the work implement when dipper stick cylinder 11 arrives at the position close to the stroke end.

As a result, boom 6 stops in response to switching to the control for stopping the work implement, whereby the speed of boom 6 comes to zero.

When a large speed change is produced at the time of the stop of boom 6, a greater shock may be applied to boom 6. In this case, the operator may have a sense of discomfort that lowers service efficiency of land grading.

Figure 10:
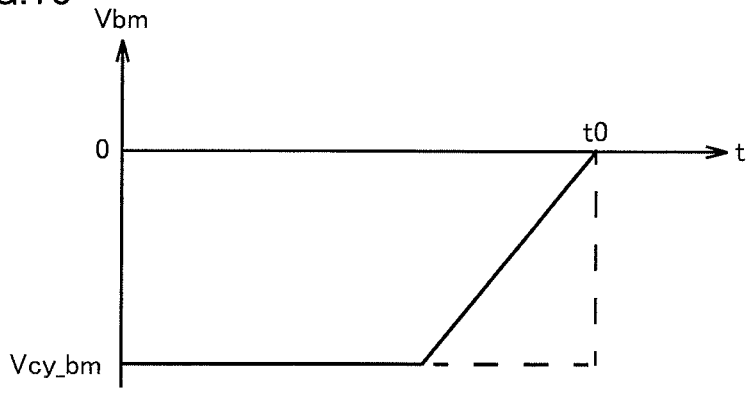
FIG. 10 is a chart illustrating a boom speed during boom intervention control for land grading according to the embodiment.

FIG. 10 is a chart illustrating a boom speed during boom intervention control for land, grading according to the embodiment.

FIG. 10 shows a boom speed Vbm of a movement of boom 6 with respect to time t.

A positive value of boom speed Vbm indicates a rising speed of boom 6 in a rising state, while a negative value of boom speed Vbm indicates a lowering speed of boom 6 in a lowering state.

Boom 6 is provided as a part of work implement 2, wherefore boom speed Vbm is equivalent to a speed of work implement 2. The rising speed of boom 6 corresponds to a rising speed of work implement 2, while the lowering speed of boom 6 corresponds to a lowering speed of work implement 2.

According to the embodiment, each of the rising speed and the lowering speed of work implement 2 is referred to as a shift speed of work implement 2. The shift speed of work implement 2 during rising has a positive value, while the shift speed of work implement 2 during lowering has a negative value.

According to the present embodiment presented by way of example, boom speed Vbm is set to a predetermined boom speed limit Vcy_bm during lowering of boom 6.

In this case, dipper stick cylinder 11 arrives at a position close to the stroke end at a time t0. The intervention control is canceled at this time. The intervention control thereby switches to control for stopping the work implement.

According to the present embodiment, the intervention control is canceled in response to an arrival of dipper stick cylinder 11 at the position close to the stroke end, and boom speed Vbm is set to zero.

In this case, a large speed change of the boom speed is produced at the time of canceling of the intervention control. Accordingly, a shock may be caused along with the speed change of the boom speed.

According to the embodiment, reduction of the boom speed is initiated to stop boom 6 before cancellation (stop) of the intervention control.

More specifically, there is provided a limiting table that specifies a speed limit of the boom speed in accordance with a cylinder length of the dipper stick cylinder.

Figure 11:
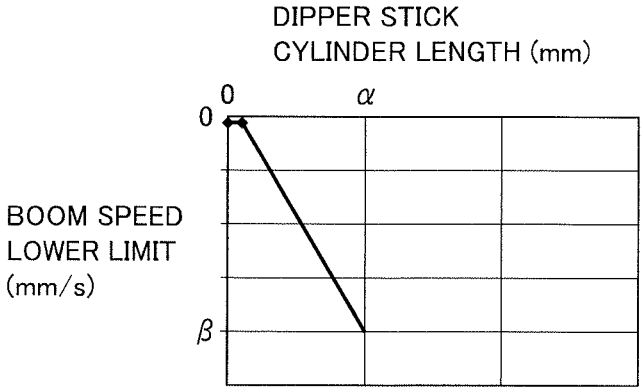
FIG. 11 is a chart illustrating a limiting table for a boom speed according to the embodiment.

FIG. 11 is a chart illustrating the limiting table for the boom speed according to the embodiment.

FIG. 11 illustrates increase in reduction of the boom speed with nearness to the stroke end of dipper stick cylinder 11.

According to the present embodiment, the speed limit of the boom speed is set to a lower limit β when dipper stick cylinder 11 enters a range of a predetermined distance α from the stroke end. Thereafter, the boom speed changes from boom speed lower limit β at a rate of predetermined deceleration with nearness to the stroke end of dipper stick cylinder 11.

With reference to the limiting table, the boom speed is allowed to change at the rate of predetermined deceleration before cancellation (stop) of the intervention control.

Accordingly, reduction of a rapid speed change of the boom speed, and therefore reduction of a shock applied to boom 6 along with the speed change are achievable.

Note that the predetermined deceleration defined by the limiting table may be varied to any values depending on the characteristics of hydraulic excavator 100.

Work implement controller 26 starts limiting the boom speed with reference to the limiting table before cancellation (stop) of the intervention control.

The intervention control is canceled (stopped) when dipper stick cylinder 11 arrives at the position close to the stroke end. The position close to the stroke end corresponds to an area around the stroke end. Whether or not dipper stick cylinder 11 has arrived at the position close to the stroke end may be calculated based on dipper stick cylinder length LS2 detected by second stroke sensor 17. Similarly, whether or not dipper stick cylinder 11 has entered the range of predetermined distance α from the stroke end may be calculated based on dipper stick cylinder length LS2 detected by second stroke sensor 17.

According to the embodiment, work implement controller 26 limits the boom speed with reference to the limiting table when determining that dipper stick cylinder 11 has entered the range of predetermined distance a from the stroke end based on dipper stick cylinder length LS2 detected by second stroke sensor 17.

When a large speed change of boom 6 is produced at the time of canceling (stopping) of the intervention control, the operator has a sense of discomfort caused by a rapid speed reduction of boom 6.

According to the present embodiment, work implement controller 26 limits the boom speed with reference to the limiting table such that the boom speed gradually approaches zero when determining that dipper stick cylinder 11 has entered the range of predetermined distance α from the stroke end based on dipper stick cylinder length LS2 detected by second stroke sensor 17.

This change reduces a rapid speed decrease of boom 6, wherefore discomfort given to the operator decreases. Moreover, a shock caused by rapid speed reduction of boom 6 decreases.

More specifically, intervention speed calculation unit 26D of the work implement controller illustrated in FIG. 4 obtains boom speed limit Vcy_bm.

Subsequently, decision unit 26J of work implement controller 26 illustrated in FIG. 4 performs decision.

Decision unit 26J determines whether or not dipper stick cylinder 11 has entered the range of predetermined distance a from the stroke end based on dipper stick cylinder length LS2 detected by second stroke sensor 17.

When determining that dipper stick cylinder 11 has entered the range of predetermined distance α from the stroke end, decision unit 26J decides to correct boom speed limit Vcy_bm, and instructs intervention speed correction unit 26F to correct boom speed limit Vcy_bm.

Intervention speed correction unit 26F of control unit 26CNT obtains corrected boom speed limit Vcy_bm', and outputs boom speed limit Vcy_bm' to intervention command calculation unit 26E of control unit 26CNT. More specifically, intervention speed correction unit 26F obtains corrected boom speed limit Vcy_bm' based on the limiting table.

Intervention command calculation unit 26E of control unit 26CNT generates boom command signal CBI based on corrected boom speed limit Vcy_bm' to control intervention valve 27C. Work implement controller 26 changes the lowering speed of boom 6 by performing these processes.

More specifically, intervention speed correction unit 26F performs control such that boom speed limit Vcy_bm finally becomes zero at the rate of predetermined deceleration.

On the other hand, when determining that dipper stick cylinder 11 is out of the range of predetermined distance a from the stroke end, decision unit 26J decides not to correct boom speed limit Vcy_bm. Intervention speed correction unit 26F outputs boom speed limit Vcy_bm to intervention command calculation unit 26E without correction. In this case, boom command signal CBI is generated based on boom speed limit Vcy_bm to control intervention valve 27C.

According to the present embodiment described herein, intervention speed correction unit 26F obtains boom speed limit Vcy_bm' corrected with reference to the limiting table to limit the speed of boom 6. Alternatively, boom command signal CBI output from intervention command calculation unit 26E may be corrected instead of correction into boom speed limit Vcy_bm'. More specifically, the speed of boom 6 may be reduced by limiting a current value corresponding to a boom command speed output from intervention command calculation unit 26E

Control Method for Work Machine of Embodiment

Figure 12:
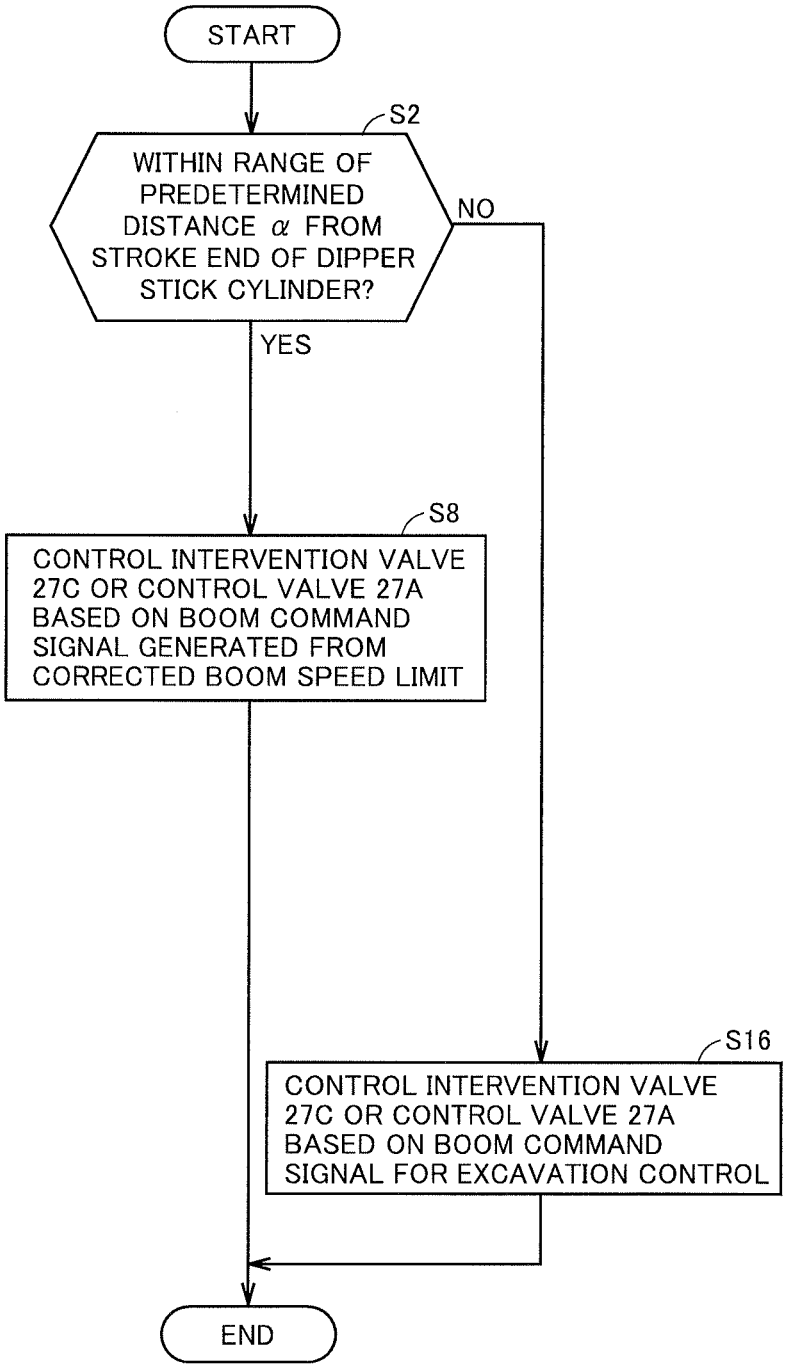
FIG. 12 is a chart illustrating a flow of a control method for the work machine according to the embodiment.

FIG. 12 is a chart illustrating a flow of a control method for the work machine according to the embodiment.

Referring to FIG. 12, the control method for the work machine according to the embodiment is performed by work implement controller 26.

In step S2, decision unit 26J of work implement controller 26 illustrated in FIG. 4 determines whether or not dipper stick cylinder 11 has entered the range of predetermined distance α from the stroke end. More specifically, decision unit 26J determines whether or not dipper stick cylinder 11 has entered the range of predetermined distance a from the stroke end based on dipper stick cylinder length LS2 detected by second stroke sensor 17.

When decision unit 26J determines in step S2 that dipper stick cylinder 11 is out of the range of predetermined distance α from the stroke end (NO in step S2), intervention command calculation unit 26E of work implement controller 26 in step S16 generates boom command signal CBI based on boom speed limit Vcy_bm not subjected to correction to control intervention valve 27C or control valve 27A.

On the other hand, when decision unit 26J determines in step S2 that dipper stick cylinder 11 has entered the range of predetermined distance a from the stroke end (YES in step S2), boom command signal CBI is generated based on the corrected boom speed limit to control intervention valve 27C or control valve 27A (step S8). More specifically, intervention speed correction unit 26F obtains corrected boom speed limit Vcy_bin' based on the limiting table. Intervention command calculation unit 26E generates boom command signal CBI based on corrected boom speed limit Vcy_bm', and controls intervention valve 27C or control valve 27A. Work implement controller 26 changes the lowering speed of boom 6 by performing these processes. Thereafter, the process ends (END).

<Electric Control Lever>

According to the embodiment, operation apparatus 25 includes pilot hydraulic control levers. However, operation apparatus 25 may include an electric left control lever 25La and an electric right control lever 25Ra.

When each of left control lever 25La and right control lever 25Ra is constituted by an electric lever, a manipulated variable input by each control lever is detected by a potentiometer. The manipulated variable input by each of left control lever 25La and right control lever 25Ra and detected by the potentiometer is acquired by work implement controller 26.

Work implement controller 26 having detected an operation signal of the electric control lever performs control similar to the corresponding control performed by using the pilot hydraulic control lever.

According to the embodiment described above, work implement controller 26 limits the boom speed based on the limiting table when determining that dipper stick cylinder 11 has entered the range of predetermined distance α from the stroke end based on dipper stick cylinder length LS2 detected by second stroke sensor 17.

Work implement 2 includes boom 6, dipper stick 7, and bucket 8. However, the attachment of work implement 2 is not limited to them, and other types of attachment than bucket 8 may be employed. The work machine is only required to include a certain work implement. The work implement included in the work machine is not limited to hydraulic excavator 100.

The embodiment disclosed herein is presented by way of example, and therefore is not limited to the specific details described herein. It is intended that the scope of the present invention is defined only by the appended claims, and therefore includes all changes made within meanings and ranges equivalent to the scope of the appended claims.

REFERENCE SIGNS LIST

1: vehicular body, 2: work implement, 3: upper revolving unit, 4: operator's cab, 5: traveling apparatus, 6: boom, 7: dipper stick, 8: bucket, 10: boom cylinder, 11: dipper stick cylinder, 12: bucket cylinder, 13 boom pin, 14: dipper stick pin, 15: bucket pin, 16: first stroke sensor, 17: second stroke sensor, 18: third stroke sensor, 19: position detection device, 26: work implement controller, 26A: relative position calculation unit, 26B: distance calculation unit, 26C: target speed calculation unit, 26CNT: control unit, 26D: intervention speed calculation unit, 26E: intervention command calculation unit, 26F: intervention speed correction unit, 26J: decision unit, 26P: processing unit, 26Q: storage unit.

The invention claimed is:

1. A work machine comprising:

a work implement;

a vehicle body connected to the work implement;

an operation apparatus for operating the work implement; and a controller for controlling the work implement, wherein the work implement includes a boom connected to the vehicle body, a dipper stick connected to the boom, and a bucket connected to the dipper stick, wherein the operation apparatus outputs an operation command for operating the boom, the dipper stick, and the bucket, and wherein the controller:

performs intervention control for controlling the boom based on the operation command for a dumping operating by operating the dipper stick, and reduces a speed of the work implement during the intervention control to stop the work implement before completion of the intervention control.

2. The work machine according to claim 1, wherein the work implement further includes a dipper stick cylinder for driving the dipper stick, and wherein the controller further:

determines whether the dipper stick cylinder is at a position close to a stroke end of the dipper stick cylinder, and limits the speed of the work implement when the controller determines that the dipper stick cylinder is at the position close to the stroke end based on a result of the determination.

3. The work machine according to claim 2, wherein the controller further:

determines whether the dipper stick cylinder has arrived within a predetermined range from the stroke end, and limits the speed of the work implement when the controller determines that the dipper stick cylinder has arrived within the predetermined range from the stroke end.

4. The work machine according to claim 1, wherein the controller executes the intervention control to bring the work implement closer to a target excavation topography by controlling the boom to descend based on the operation command to cause the dipper stick to perform the dumping operation.

5. A control method for a work machine including a work implement, a vehicle body connected to the work implement, and an operation apparatus for operating the work implement, wherein the work implement includes a boom connected to the vehicle body, a dipper stick connected to the boom, and a bucket connected to the dipper stick, wherein the operation apparatus outputs an operation command for operating the boom, the dipper stick, and the bucket, and the method comprising the steps of:

performing intervention control for controlling the boom based on the operation command for a dumping operating by operating the dipper stick; and reducing a speed of the work implement during the intervention control to stop the work implement before completion of the intervention control.

6. The control method for the work machine according to claim 5, wherein the work implement further includes a dipper stick cylinder for driving the dipper stick, and wherein the method further comprising the steps of:

determining whether the dipper stick cylinder is at a position close to a stroke end of the dipper stick cylinder; and limiting the speed of the work implement when the controller determines that the dipper stick cylinder is at the position close to the stroke end based on a result of the determination.

7. The control method for the work machine according to claim 6, further comprising the steps of:

determining whether the dipper stick cylinder has arrived within a predetermined range from the stroke end; and limiting the speed of the work implement when the controller determines that the dipper stick cylinder has arrived within the predetermined range from the stroke end.

8. The control method for the work machine according to claim 5, wherein the intervention control is executed to bring the work implement closer to a target excavation topography by controlling the boom to descend based on the operation command to cause the dipper stick to perform the dumping operation.

* * * * *